United States Patent [19]

Sukolics

[11] 4,452,029

[45] Jun. 5, 1984

[54] METHOD FOR JOINING WALL PANELS

[75] Inventor: Ronald D. Sukolics, St. Louis, Mo.

[73] Assignee: Carl Dunmon & Associates, Inc., St. Louis, Mo.

[21] Appl. No.: 387,278

[22] Filed: Jun. 10, 1982

Related U.S. Application Data

[62] Division of Ser. No. 139,004, Apr. 10, 1980, Pat. No. 4,344,267.

[51] Int. Cl.[3] ..... E04G 21/00

[52] U.S. Cl. ..... 52/747; 52/510; 52/385

[58] Field of Search ..... 52/747, 748, 533, 551, 52/510, 511, 536, 385, 387

[56] References Cited

U.S. PATENT DOCUMENTS

| | | | |
|---|---|---|---|
| 2,312,673 | 3/1943 | Rizzolo | 52/762 |
| 3,667,182 | 6/1972 | Stemler | 52/762 |
| 3,832,820 | 9/1974 | Eggert | 52/461 |

FOREIGN PATENT DOCUMENTS

| | | | |
|---|---|---|---|
| 675285 | 9/1983 | Canada | 52/385 |
| 1381143 | 10/1964 | France | 52/510 |
| 176270 | 4/1935 | Switzerland | 52/385 |
| 733606 | 7/1955 | United Kingdom | 52/461 |

*Primary Examiner*—Henry E. Raduazo

*Attorney, Agent, or Firm*—Bachman and LaPointe

[57] ABSTRACT

A method for joining panel members into walls or dividers is provided which allow thermal expansion of the panel members to be absorbed by the joints. The panel construction includes turned down edges having grooves on the inside faces of the edges. Each edge is sized to fit side-by-side in a channel with the edge of an adjoining panel and with their grooves over ridges on the inner walls of the sides of the channel. An insert member having protrusions on its sides is wedged between the side-by-side edges for maintaining the grooves over the ridges while allowing pivotal movement of the edges around the ridges.

3 Claims, 7 Drawing Figures

METHOD FOR JOINING WALL PANELS

This is a division of application Ser. No. 139,004, filed Apr. 10, 1980 and now U.S. Pat. No. 4,344,267.

BACKGROUND OF THE INVENTION

This invention relates to methods for joining metal panel members to building structures for forming walls and dividers without bolts, screws or other fasteners protruding from the wall. More particularly, the invention relates to constructions allowing thermal expansion of the wall panel members to be absorbed by the connecting apparatus without causing warping or distortion of the wall panel members.

Walls have been constructed in the past using panels with wedges for securely trapping and holding the edges of panel members in place. In these prior panel attaching devices, the edges of the panel members are securely locked into position in such a manner that thermal expansion of the panel members produces warping or other distortion in the panel members.

SUMMARY OF THE INVENTION

Among the objects of the present invention is the provision of a panel securing apparatus which allows for thermal expansion of the panel members. It is also an object of this invention to provide for panel members having turned down edges with grooves longitudinally along the inner face of the edges for fitting into a channel member having ridges longitudinally along the inner walls of the channels and sized to cooperate with one another such that the turned down edges may rotate around the ridges of the channel member allowing thermal expansion of the panel members to be absorbed. It is a further object of the invention to provide a seam between the panel members which does not have protrusions such as bolts or other fasteners and in which a sealant may be placed to provide a watertight seal. It is a further object of the invention to provide a channel member which may be loosely secured to one edge of a panel member as the panels are being assembled into the wall, which attachment will not interfere with the thermal expansion allowing properties of the attachment apparatus.

It is a further object of the invention to provide a panel securing apparatus which will allow the angle between the face of the panel member and its turned down edge to be less than 90°. Other objects and features will be in part apparent and in part pointed out hereinafter.

The invention accordingly comprises the constructions and methods hereinafter described, the scope of the invention being indicated by the following claims.

In the accompanying drawings, in which several of various possible embodiments of the invention are illustrated, FIG. 1 is an elevation illustrating a portion of a wall made up of several panels of the invention and showing one method of construction of the wall by the addition of a panel with the channel of the invention attached to the edges of the panel member being added;

DETAILED DESCRIPTION

Figure 1:
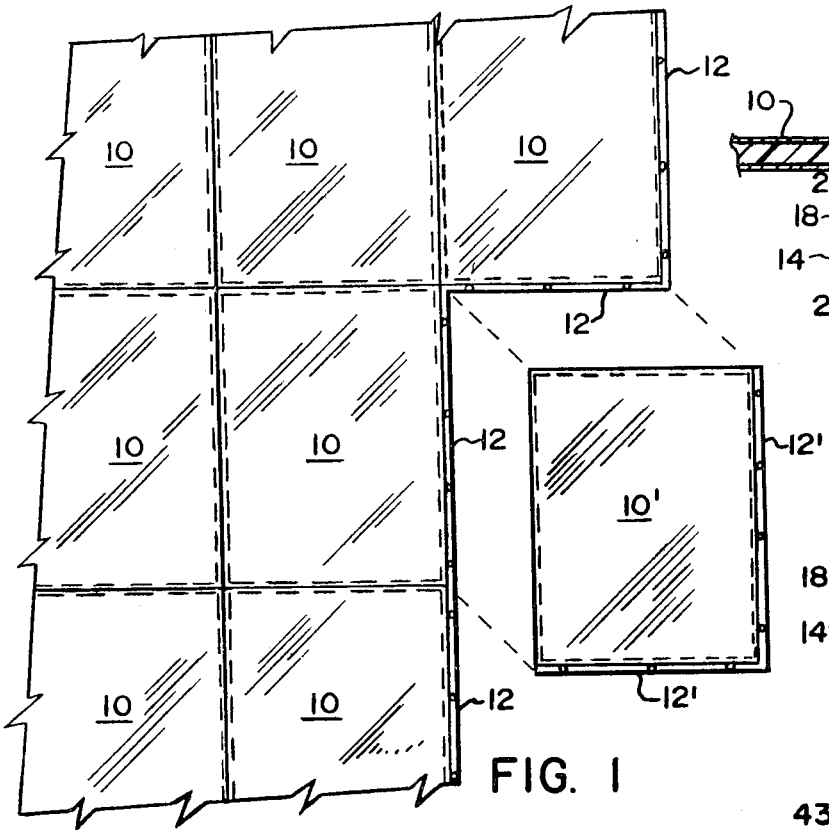

Corresponding reference characters indicate corresponding parts throughout the several views of the drawings.

FIG. 1 shows a wall composed of several panel members 10 which are held together by channel members 12 as described below. Panel members 10 may be any metal, plastic or composite panel which may be formed and machined as shown.

Channel members 12 are secured to a building structure and may be previously laid out in a grid type fashion. In the embodiment shown in FIG. 1, channel members 12' are loosely attached to two of the four edges of panel member 10'. The two edges of panel member 10' not having channels 12' attached may then be inserted into matching channels 12 already secured to the building structure. Channel members 12' are then secured to the building structure. This method alleviates the need to accurately locate and secure a grid to the building structure before assembling panel members 10 into a wall.

Figure 2:
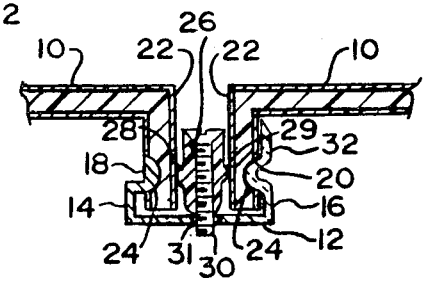
FIG. 2 is a cross-sectional view of one form of the present invention.

FIG. 2 shows the construction of one preferred embodiment of the invention. Channel member 12 has a short side 14 and a long side 16. Short side 14 has a panel interlock 18 in the form of a ridge running longitudinally along the length of side 14. A panel interlock 20 is also formed on the inner side of long side 16 of channel member 12. Channel member 12 may be made of any suitable known material such as aluminum.

Edges 22 of panel members 10 are turned down such that they may be inserted into channel member 12. Grooves 24 are provided longitudinally on the inner sides of turned down edges 22 and are sized to accept interlocks 18 and 20 of sides 14 and 16 of channel 12 respectively. An insert strip 26 is located between turned down edges 22 such that grooves 24 are maintained in cooperation with interlocks 18 and 20.

Screws 30 are screwed through insert 26 and into hole 31 attaching insert 26 to channel member 12.

Insert 26 of the embodiment of FIG. 2 is a vinyl channel which is inserted bottom side up between turned down edges 22 of panel members 10. Screws 30 also serve to prevent vinyl channel 26 from collapsing and releasing interlocks 18 and 20 from grooves 24. Protrusions 28 and 29 are provided along the sides of insert 26 and positioned such that when insert 26 is fastened in place by screws 30, protrusions 28 and 29 are behind interlocks 18 and 20 respectively. These protrusions assist in maintaining grooves 24 over interlocks 18 and 20 while allowing pivotal movement of edges 22 around interlocks 18 and 20.

Figure 3:
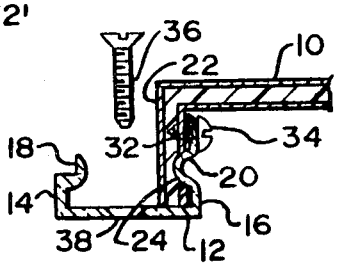
FIG. 3 is a cross-sectional view of one form of the invention for erection purposes.

Long side 16 of channel 12 has an extension 32 which may be used for construction purposes. FIG. 3 shows a small screw 34 which loosely attaches extension 32 to turned down edge 22 of one panel member 10. Other attaching means such as double-sided tape, adhesive, or other clip means may be used for holding channel 12 to edge 22 during erection, but which does not provide a connection substantial enough to interfere with rotating movement of edge 22 around interlock 20.

When new panel 10′ is positioned as illustrated in FIG. 1, attaching screws 36 are screwed through holes 38 in channel 12 to securely attach channel 12 to the structure. Holes 38 are offset from holes 31 such that screws 30 and 36 will not interfere with one another.

Figure 4:
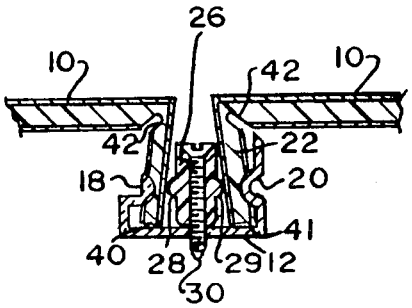
FIG. 4 is a cross-sectional view of the embodiment of FIG. 2 showing the absorption of thermal expansion of the panel.

FIG. 4 illustrates the rotation of edges 22 around interlocks 18 and 20 when panel members 10 are subject to thermal expansion. It will be noted that edges 22 are sized such that there is a slight space 40 and 41 between the ends of edges 22 and the bottom of channel member 12. The rotation action may also be enhanced by providing reduced areas 42 at the inner corner where panel members 10 join turned down edges 22. Area 42 may be provided by machining or stamping with an appropriate die as panel members 10 are being formed.

Figure 5:
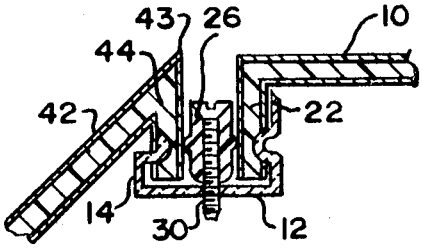
FIG. 5 is one embodiment of the invention showing the angle between a turned down edge of a panel member and its face being less than 90°.

FIG. 5 shows an embodiment wherein the angle between the face of panel member 42 is less than 90° with its turned down edge 44. Shortened side 14 of channel 12 fits between panel 42 and edge 44 such that edge 43 is flush with the face of panel 10 as shown.

Figure 6:
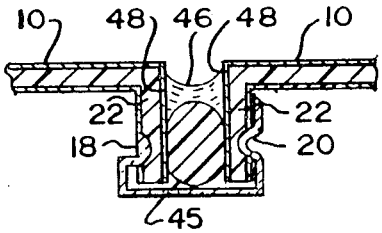
FIG. 6 is a cross-sectional view showing a second embodiment of the invention.

FIG. 6 shows another embodiment of the invention wherein a styrene bead 45 is used in place of insert 26 as previously described. Styrene bead 45 has a generally oval cross-section with the girth along the minor axis of the oval providing wedging action holding edges 22 in place while allowing rotation around interlocks 18 and 20 as previously described.

If desired, a flexible sealant 46 may be injected between the separated turned down edges 22 to form a watertight seal. Such a sealant may be used with any of the embodiments of the invention. The faces 48 of turned down edges 22 may be prepared to be suitable bonding surfaces with sealant 46 if desired for insuring a watertight seal.

Figure 7:
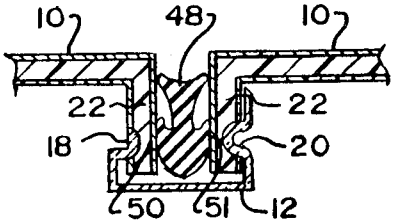
FIG. 7 is a cross-sectional view of another embodiment of the invention.

FIG. 7 shows another embodiment of the invention wherein the insert is formed by a neoprene wedge 48 having an arrowhead cross-section. Flukes 50–51 of the arrowhead of wedge 48 are positioned behind interlocks 18 and 20 to provide wedging action for maintaining turned down edges 22 in place while allowing rotation of edges 22 as previously described. Flukes 50 and 51, as well as the shape of the tail of wedge 48, additionally provide greater resistance to the withdrawing of wedge 48 maintaining wedge 48 in the position shown in FIG. 7.

The invention thus provides an apparatus for joining panel members together to form a wall which allows thermal expansion of the panel members without causing warping or distortion of the panel members.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of joining panel members along their edges for providing thermal expansion comprising providing said panel members with turned down edges having longitudinal grooves running on the inside face and along the length of said edges, providing a channel having longitudinal ridges along the inner walls of its sides for fitting into said longitudinal grooves of said turned down edges, said ridges sized to cooperate with said grooves to allow pivotal movement of said edges around the ridges, securing said channel to a support for supporting the panels in place, locating the turned down edges of said panel members in a side-by-side relationship in said channel so that said grooves interlock with said ridges, and inserting a wedging strip between said turned down edges for maintaining said grooves over said ridges whereby the shape of said wedging strip, said grooves and said ridges cooperate so as to permit pivotal movement of said edges around said ridges for allowing thermal expansion of said panels.

2. A method according to claim 1 further comprising, before the securing of said channel step, the step of loosely fastening one side of said channel to one of the turned down edges of one panel member.

3. A method of securing a plurality of panel members to a substructure so as to accommodate thermal expansion of said panel members comprising providing said panel members with turned down edges having longitudinal grooves running on the inside face and along the length of said edges; providing a plurality of channel members each of said channel members having longitudinal ridges along the inner walls of its sides for fitting into said longitudinal grooves of the turned down edges of said panel members; said ridges being sized to cooperate with said grooves to allow pivotal movement of said edges around said ridges; loosely fastening one or more of said channel members to one or more of the edges of a first panel member; securing said channel members affixed to said first panel member to the aforementioned substructure; loosely fastening at least one additional channel member to a second panel member; locating an edge of said second panel member, other than an edge to which a channel has been affixed, in side-by-side relationship with a turned down edge of said first panel member in the channel loosely affixed to the turned down edge of said first channel member so that the grooves in said first and said second panel members interlock with the ridges of said channel loosely affixed to said first panel member; inserting a wedging strip between said turned down edges for maintaining said grooves over said ridges whereby the shape of said wedging strip, said grooves and said ridges cooperate so as to permit pivotable movement of said edges around said ridges so as to accommodate thermal expansion of said panel members; securing the channel affixed to said second panel member to the aforementioned substructure; repeating the steps of loosely affixing at least one channel to an edge of each of the remaining panel members; installing the panel members in interlocking relationship in the channels loosely affixed to the previously mounted panel members; inserting a wedge strip between the edges of the panel members and securing the channels to the substructure until all the panel members have been secured to the substructure.

* * * * *